US008474930B2

(12) United States Patent
Rasmussen

(10) Patent No.: US 8,474,930 B2
(45) Date of Patent: Jul. 2, 2013

(54) INKJET PRINTER INK DELIVERY SYSTEM

(76) Inventor: Donald O. Rasmussen, Costa Mesa, CA (US)

( * ) Notice: Subject to any disclaimer, the term of this patent is extended or adjusted under 35 U.S.C. 154(b) by 143 days.

(21) Appl. No.: 13/199,347

(22) Filed: Aug. 26, 2011

(65) Prior Publication Data

US 2012/0050357 A1 Mar. 1, 2012

Related U.S. Application Data

(60) Provisional application No. 61/402,484, filed on Aug. 30, 2010.

(51) Int. Cl.
*B41J 29/38* (2006.01)

(52) U.S. Cl.
USPC ..... 347/6; 347/89

(58) Field of Classification Search
USPC ..... 347/6, 7, 65, 67, 84–87, 89
See application file for complete search history.

(56) References Cited

U.S. PATENT DOCUMENTS

| | | | | |
|---|---|---|---|---|
| 3,974,768 | A | 8/1976 | Grobman | |
| 4,526,102 | A | 7/1985 | Grobman | |
| 4,607,261 | A | 8/1986 | McCann et al. | |
| 4,614,948 | A | 9/1986 | Katerberg et al. | |
| 4,750,005 | A | 6/1988 | Piatt et al. | |
| 5,231,424 | A | 7/1993 | Kaneko et al. | |
| 5,818,485 | A | 10/1998 | Rezanka | |
| 6,017,117 | A | 1/2000 | McClelland et al. | |
| 6,123,412 | A | 9/2000 | Yamamoto et al. | |
| 6,227,660 | B1 | 5/2001 | McClelland et al. | |
| 6,312,113 | B1 | 11/2001 | Murad | |
| 6,343,857 | B1 | 2/2002 | Cowger | |
| 6,428,156 | B1 * | 8/2002 | Waller et al. | 347/89 |
| 6,540,346 | B1 | 4/2003 | Akahira et al. | |
| 6,561,637 | B2 | 5/2003 | Hino | |
| 7,828,425 | B2 | 11/2010 | Kang et al. | |
| 7,871,160 | B2 | 1/2011 | Kang et al. | |
| 2009/0040249 | A1 | 2/2009 | Wouters et al. | |

* cited by examiner

*Primary Examiner* — Juanita D Jackson
(74) *Attorney, Agent, or Firm* — Russo & Duckworth, LLP; David G. Duckworth

(57) ABSTRACT

An ink delivery system is provided for an inkjet printer. The ink delivery system includes a supply of ink and an inkjet printhead having a first port, second port and an ink ejection nozzle. The inkjet printhead is connected to the ink supply tank by a first fluid supply path. The first fluid supply path includes first and second check valves which permit ink to flow from the ink supply tank to the inkjet printhead, but prevent fluid flow in the opposite direction. The ink delivery system includes a second fluid supply path which is connected at one end to the first fluid supply path between the respective first and second check valves. The second fluid supply path is connected at its opposite end to the inkjet printhead's second port. The second fluid supply path further includes a bidirectional pump so as to direct fluid flow in either direction through the second fluid supply path. The delivery system operates in various modes including a recirculate mode, pressure purge mode, maintenance mode and normal print mode.

10 Claims, 5 Drawing Sheets

INKJET PRINTER INK DELIVERY SYSTEM

RELATED APPLICATIONS

This application is a continuation-in-part of U.S. Provisional Patent Application No. 61/402,484 filed on Aug. 30, 2010.

BACKGROUND OF THE INVENTION

The present invention relates to printers. Furthermore, the present invention relates to an inkjet delivery system that conditions the ink prior to printing.

Printers are used to print output from computers or similar type of devices that generate information, onto a recording medium such as paper. Commonly available types of printers include impact printers, laser printers and inkjet printers. The term "inkjet" covers a variety of physical processes and hardware but basically these printers transfer ink from an ink supply to the recording medium in a pattern of fine ink drops. Inkjet printheads produce drops either continuously or on demand. "Continuously" means that a continuous stream of ink drops is created, e.g. by pressurizing the ink supply. Typically, continuous inkjet printing utilizes a pump to cause ink to be transmitted from a reservoir through a gunbody and nozzle in accordance with Plateau-Rayleigh instability.

"On demand" inkjet printing differs from "continuous" inkjet printing in that ink drops are only ejected from a printhead by manipulation of a physical process to momentarily overcome surface tension forces that keep the ink in the printhead. The ink is held in a nozzle, forming a meniscus. The ink remains in place unless some other force overcomes the surface tension forces that are inherent in the liquid. The most common practice is to suddenly raise the pressure on the ink, ejecting it from the nozzle. One category of drop-on-demand inkjet printheads uses the physical phenomenon of electrostriction, a change in transducer dimension in response to an applied electric field. Electrostriction is strongest in piezoelectric materials and hence these printheads are referred to as piezoelectric printheads. The very small dimensional change of piezoelectric material is harnessed over a large area to generate a volume change that is large enough to squeeze out a drop of ink from a small chamber. A piezoelectric printhead includes a multitude of small ink chambers, arranged in an array, each having an individual nozzle and a percentage of transformable wall area to create the volume changes required to eject an ink drop from the nozzle, in according with electrostriction principles.

For production type inkjet printing equipment, where high printing speeds and reliability are of the outmost importance, the conditioning of the ink is critical. The solutions proposed in the prior art only partially solve some of the problems.

Inkjet printers are prone to head nozzle clogging because of the small nozzle size and the use of water based inks. To remedy this, prior methods are to fire all the piezo elements to pump ink through the head or apply a vacuum to the printhead through a capping device. These methods have limited success because they can only apply relatively low pressure to the nozzles.

In addition, in printing where white ink is used, the titanium oxide pigment tends to come out of suspension from the vehicle used. To remedy this, conditioning by agitation or stirring is needed. Prior methods are to fire all the piezo elements to pump ink through the head or apply a vacuum to the printhead through a capping device which wastes ink. Colored inks may also benefit from conditioning by agitation or stirring.

Therefore, there is a significant need to provide an ink delivery system, incorporated in an inkjet printer, that brings the ink in optimal condition immediately after startup and keeps it in optimal condition during printing.

SUMMARY OF THE INVENTION

This invention is directed to an ink delivery system and method of operation which provides a means of supplying ink, re-circulating ink to condition it, pressure purging clogged nozzles and priming an inkjet printer printhead with a single bidirectional pump.

The ink delivery system includes of the primary ink supply path which extends from the ink cartridge through a first check valve, through a filter, through a damper, through a second check valve and finally into the printhead. The ink delivery system also includes a secondary supply path which extends from the primary ink supply path after the first check valve, through a bidirectional pump, through a second filter and into the printhead. A pressure sensor is included in the secondary path to monitor pressure. The printhead has two inlet/outlet ports which are connected to an ink reservoir within the printhead.

Advantageously, the system does not expose the ink to air at any point. Preferably, the ink cartridge has a bag which is free of air and collapses as the ink is used. The ink cartridge bag has an outlet equipped with a spring loaded valve that opens or closes when the cartridge is inserted into or removed from the cartridge bag, thus preventing exposure to air. There are no ink reservoirs or other elements in the system which exposes the ink to air.

The ink delivery system provides for several operational modes including a normal printing mode, a re-circulation mode, a pressure purge mode, a prime/maintenance mode, and a prime with pressure mode. During normal printing, the bidirectional pump is not used. The cartridge is positioned slightly below the level of the printhead nozzle plate to prevent siphoning and maintain a small negative pressure at the printhead nozzle plate. Ink is drawn into the printhead by gravity and the pumping action of the piezoelectric elements in the printhead.

During re-circulation operation, the bidirectional pump operates at a slow rate moving the ink from the ink supply to the printhead through the filter in front of the damper, through the damper, through the second check valve, through the printhead, through the second filter and back through the pump. The first check valve prevents the ink from being pumped back into the cartridge.

During pressure purge operation, the pump operates at a faster rate to develop a pressure of 3 to 4 psi. Ink is drawn from the cartridge with the second check valve preventing back flow through the damper. Preferably, a pressure sensor is located in the secondary supply path after the second filter to provide feedback and allow servo-control of the pressure. The second check valve prevents the purge pressure from reaching the delicate damper diaphragm. This mode is also used in the initial priming operation to prime the secondary supply path.

The ink delivery system provides a "prime with maintenance station mode" which is conducted during initial setup, when changing ink, or when flushing the system with cleaning solution. For this operation, the inkjet printer includes a vertically movable maintenance station having a rubber cup. The maintenance station is raised up until the rubber cup is pressed against the face of the printhead. The cup surrounds the printhead nozzles and is interconnected to a diaphragm pump. When the diaphragm pump is activated, ink is sucked from the cartridge, through the first check valve, through the first filter, through the damper, through the second check valve and finally through the printhead.

The ink delivery system of the present invention also provides for a "prime with pressure purge mode" which is substantially the same as pressure purge mode but at a lower flow rate and pressure. This mode is used in conjunction with prime with maintenance station mode or separately during initial setup, when changing ink or when flushing the system with cleaning solution.

These and other features and advantages of the present invention will be appreciated by those skilled in the art from the following detailed description taken in conjunction with the drawings.

DETAILED DESCRIPTION OF THE DRAWINGS

DETAILED DESCRIPTION OF THE INVENTION

Figure 1:
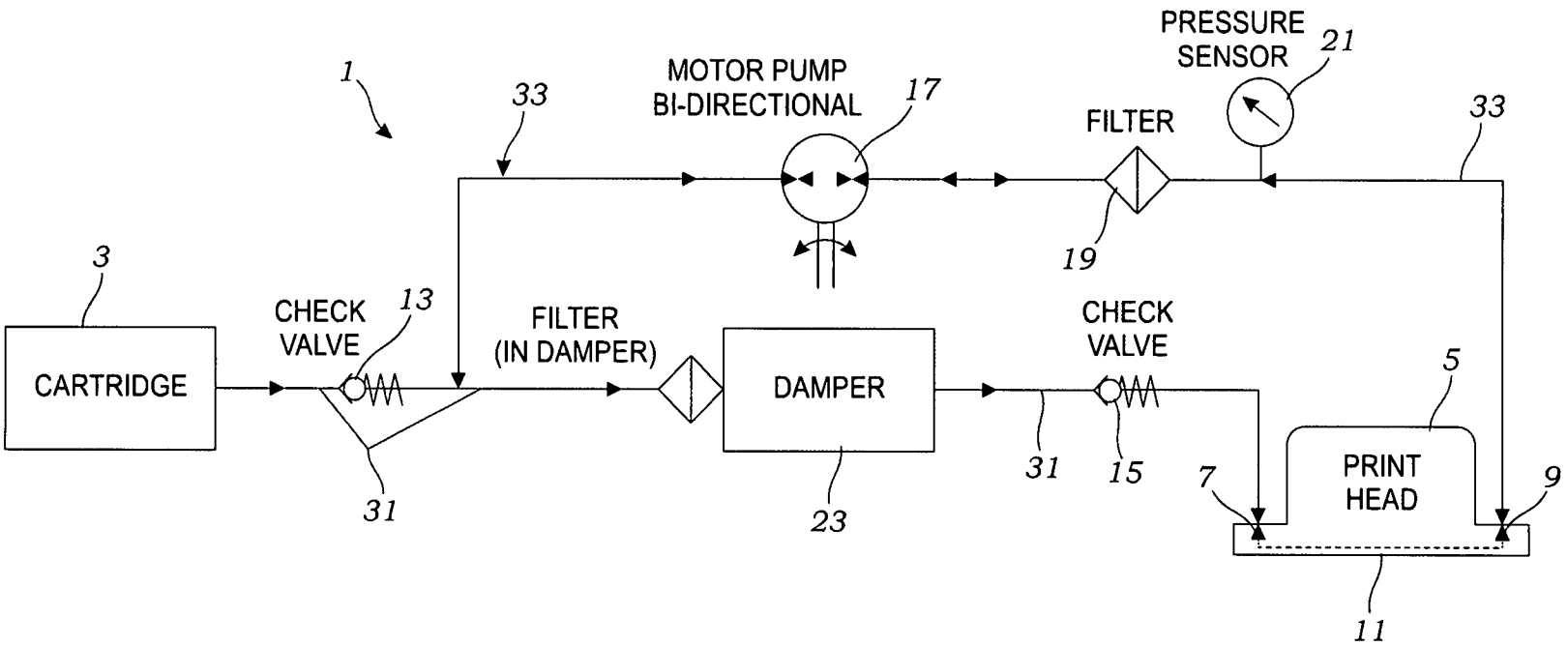
FIG. 1 is flow chart illustrating the inkjet printer ink delivery system of the present invention.

While the present invention is susceptible of the embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-5, the ink delivery system 1 includes one or more supplies of ink 3. The figures illustrate a system including only a single supply. However, those skilled in the art will understand that a typical inkjet printer will have several colors of ink including yellow, cyan, magenta, white and black. The present invention is appropriate for any traditionally available inkjet printer inks. However, preferred inks are available by Anajet, Inc., including those sold under the mark PowerBright.

The ink delivery system 1 further includes a printhead 5 having an ink ejection head 11. Of importance, the printhead 5 must have at least two ports designated herein as 7 and 9. The printhead's first port, second port and ink ejection head 11 are fluidly connected by the printhead's interior ink reservoir. Any printhead having two ports, preferably withstanding 7 psi internal pressure, would be acceptable. A preferred printhead is the Ricoh® Generation 4 printhead, part no. N220792E, though other printheads may be selected or designated by those skilled in the art.

The ink supply 3 is connected to the printhead 5 by a first ink flow supply path 31. The first supply path utilizes tubing to transport ink from the ink supply to the printhead's first port 7. The tubing may be any polyurethane or compatible tubing preferably having a Shore durometer hardness of 70A to 85A. Furthermore, the preferred tubing has a 3⁄32 inch interior diameter and a 5⁄32 inch outer diameter such as available from Freelin-Wade Fre-Thane part no. 1J-134. In the first supply path, the ink delivery system includes a first check valve 13 and second check valve 15. Preferred check valves include those with low cracking pressure such as Resenex R-721 valve and Vernay Labratories check valve part no. VA9365. As would be appreciated by those skilled in the art, the check valves are constructed and positioned so as to permit fluid flow in one direction from the ink supply cartridge 3 to the printhead 5, while preventing fluid flow in the opposite direction. The first supply path may also include a damper 23. A damper is a chamber with a thin diaphragm that mitigates pressure surges in the ink when the head reverses direction and further has a screen that filters out small particles to protect the head. The damper chamber is partially filled with ink. Further, the damper traps air that might get into the head. A preferred damper has a medium capacity chamber with integral wire mesh filter, such as provided by LK D. P. S., part number BDMT, though other dampers may be selected or designed by those skilled in the art.

The ink delivery system of the present invention further includes a second supply path 33 also utilizing tubing such as polyurethane having a 3⁄32 inch interior diameter. The tubing of the second supply path connects at one end to the tubing of the first supply path 31 between the first supply path's check valves 13 and 15. The opposite end of the second supply path 33 connects to the printhead's second port 9. Within the second supply path 33 is a bidirectional motor 17. The bidirectional motor has a first pump port and second pump port for connecting inline into the second supply path. The bidirectional pump 17 selectively provides positive pressure upstream and negative pressure downstream or alternatively provides the reverse pressure by providing negative pressure upstream and positive pressure downstream with the second supply path. A preferred bidirectional pump is a peristaltic pump sold by Welco, part number WPX1. Preferably, the bidirectional pump is constructed to obstruct fluid flow through the second supply path when the bidirectional pump is not activated. Moreover, the term bidirectional pump is intended to be interpreted broadly to include a system including a unidirectional pump but providing bidirectional pumping functionality such as using a reversing valve system. The second supply path 33 may also include a filter 19 so as to protect the printhead. Furthermore, the second supply path 33 may include a pressure sensor 21.

The ink delivery system 1 of the present invention operates in several different modes. In the traditional printing mode illustrated in FIG. 5, the bidirectional pump 17 is not operated so as to obstruct ink flow through the second supply path 33. The ink supply 3 is preferably positioned slightly below the level of the printhead nozzle plate to prevent syphoning and maintain a small negative pressure at the printhead nozzle plate. Ink is transported through the first supply path 31 by activation of the piezoelectric properties within the printhead 5. Though the ink may be printed utilizing continuous inkjet, thermal inkjet or piezoelectric inkjet mechanisms, it is preferred that the printhead 5 having a piezoelectric construction wherein a voltage is applied to the piezoelectric material so as to force fluid in the form of droplets from the inkjet head nozzle(s).

Figure 2:
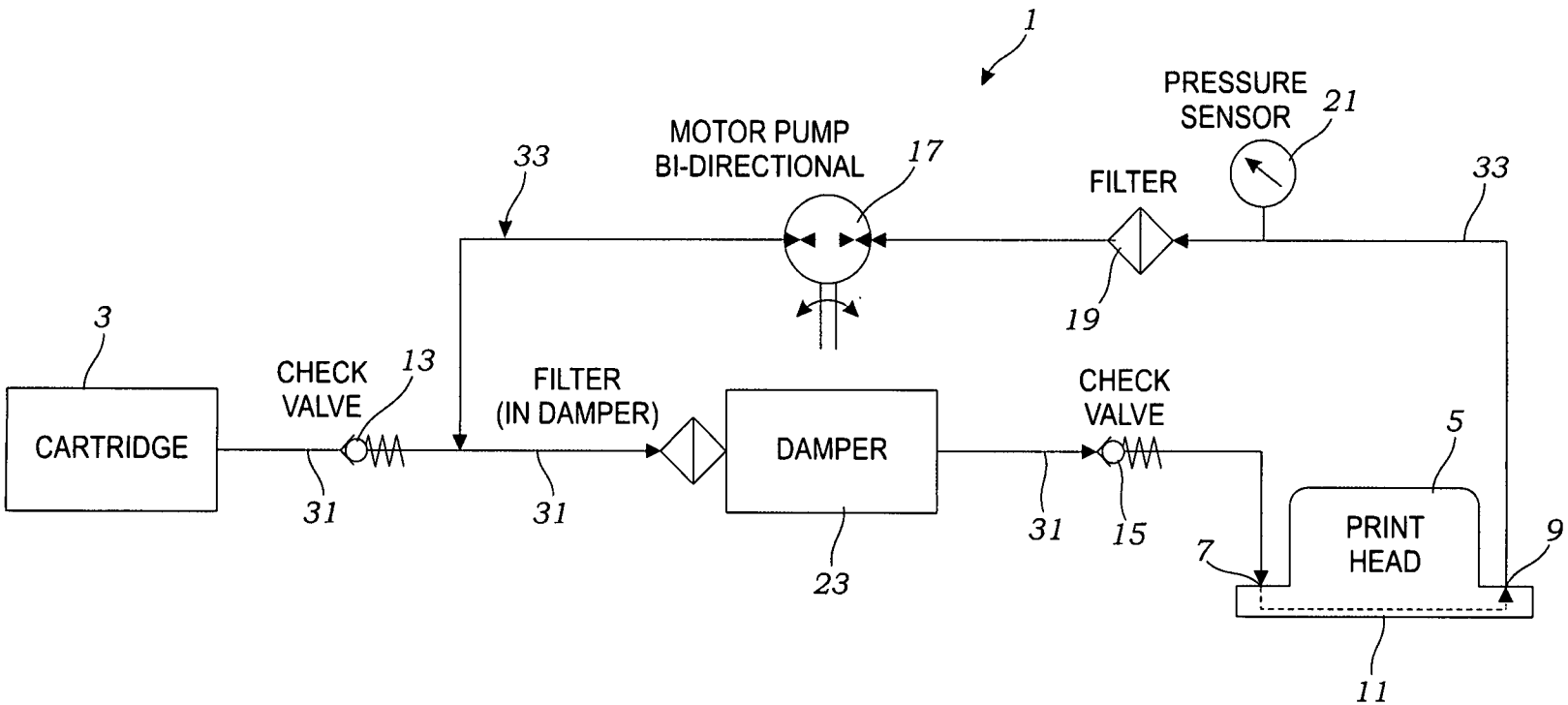
FIG. 2 is a flow chart illustrating the inkjet printer ink delivery system operating in a re-circulate mode.

In the re-circulation mode illustrated in FIG. 2, ink is circulated through the first supply path 31, second supply path 33 and printhead 5 so as to maintain colored pigments within the ink's suspension and to prevent clogged printhead nozzles. In the re-circulation operation, the bidirectional pump 17 is activated so as to pump ink at a slow rate in a counter clockwise direction propelling ink through the dampered 23, second check valve 15, printhead first port 7, printhead second port 9, through the filter 19 and back to the bidirectional pump 17. As understood by those skilled in the art, the terms clockwise and counterclockwise are meant to be used to describe operation of the ink delivery system as illustrated in FIGS. 1-5. However, the terms clockwise and counterclockwise are not to intended to be limiting in any manner. Notably, the first check valve 13 prevents ink from being pumped back into the ink supply 3.

Figure 3:
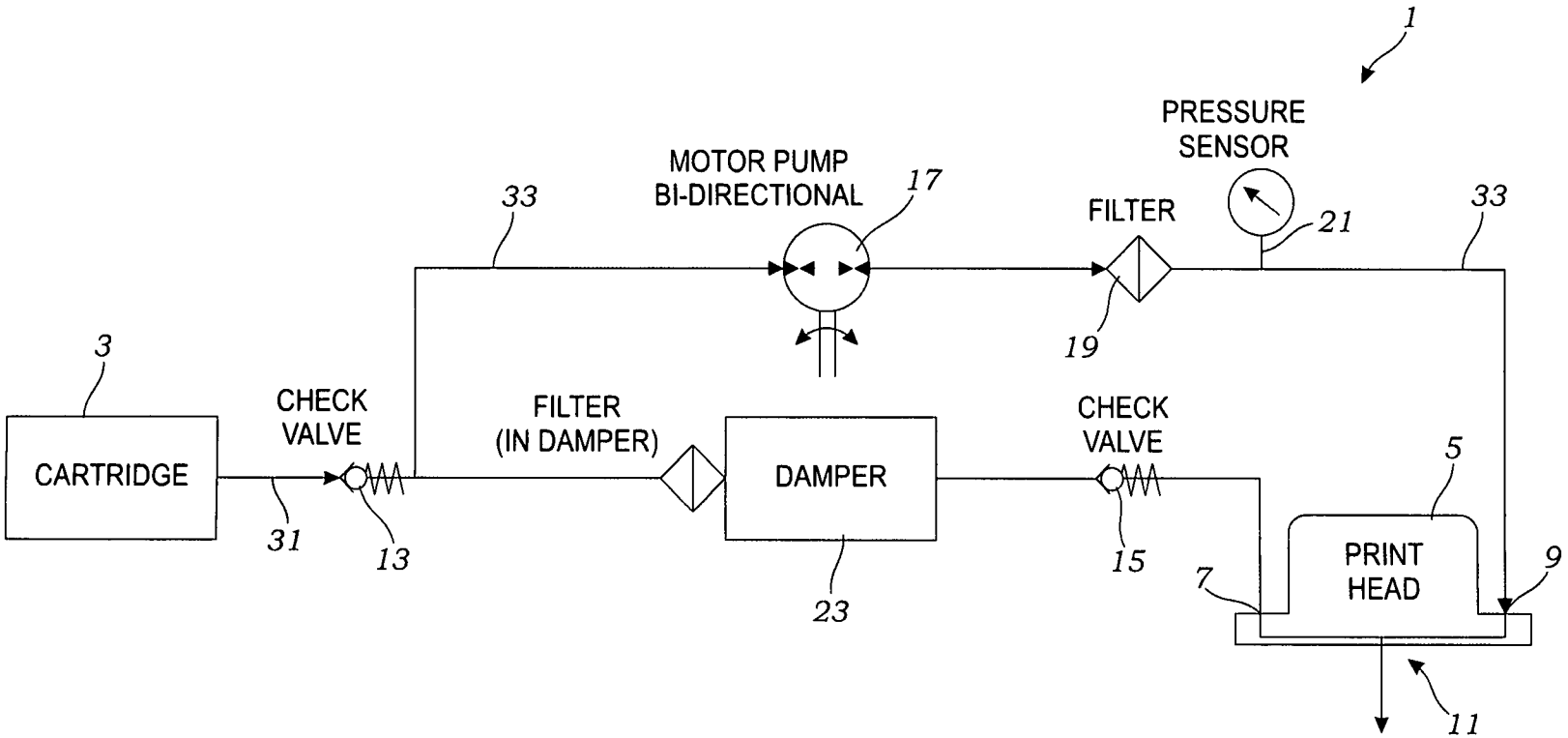
FIG. 3 is a flow chart illustrating the inkjet printer ink delivery system operating in a pressure purge mode or "priming" (fill)

The ink delivery system's pressure purge mode is illustrated in FIG. 3. During the pressure purge mode, the bidirectional pump 17 pumps ink in the clockwise direction, preferably to produce a higher pressure of 3-4 psi than provided in the re-circulation mode. As a result of second check valve 15 preventing upstream fluid flow in the first supply path 31, ink is drawn by negative pressure from the ink supply 3 through the second supply path 33 to the printhead second port 9 for ejection from the printhead nozzle 11. During the pressure purge mode, it is preferred that the pressure sensor 21 provide feedback control of the bidirectional motor 17 so as to control and maintain proper pressure in the second supply path 33.

The pressure purge may be utilized to purge unwanted ink from the second supply path. Furthermore, this mode is preferably utilized during the initial priming operation to prime and remove air from the second supply path 33. When first priming the secondary supply path, preferably the bidirectional motor is controlled to provide a lower flow rate and pressure such as during initial set up when changing inks or when flushing the second supply path 33 with cleaning solution.

Figure 4:
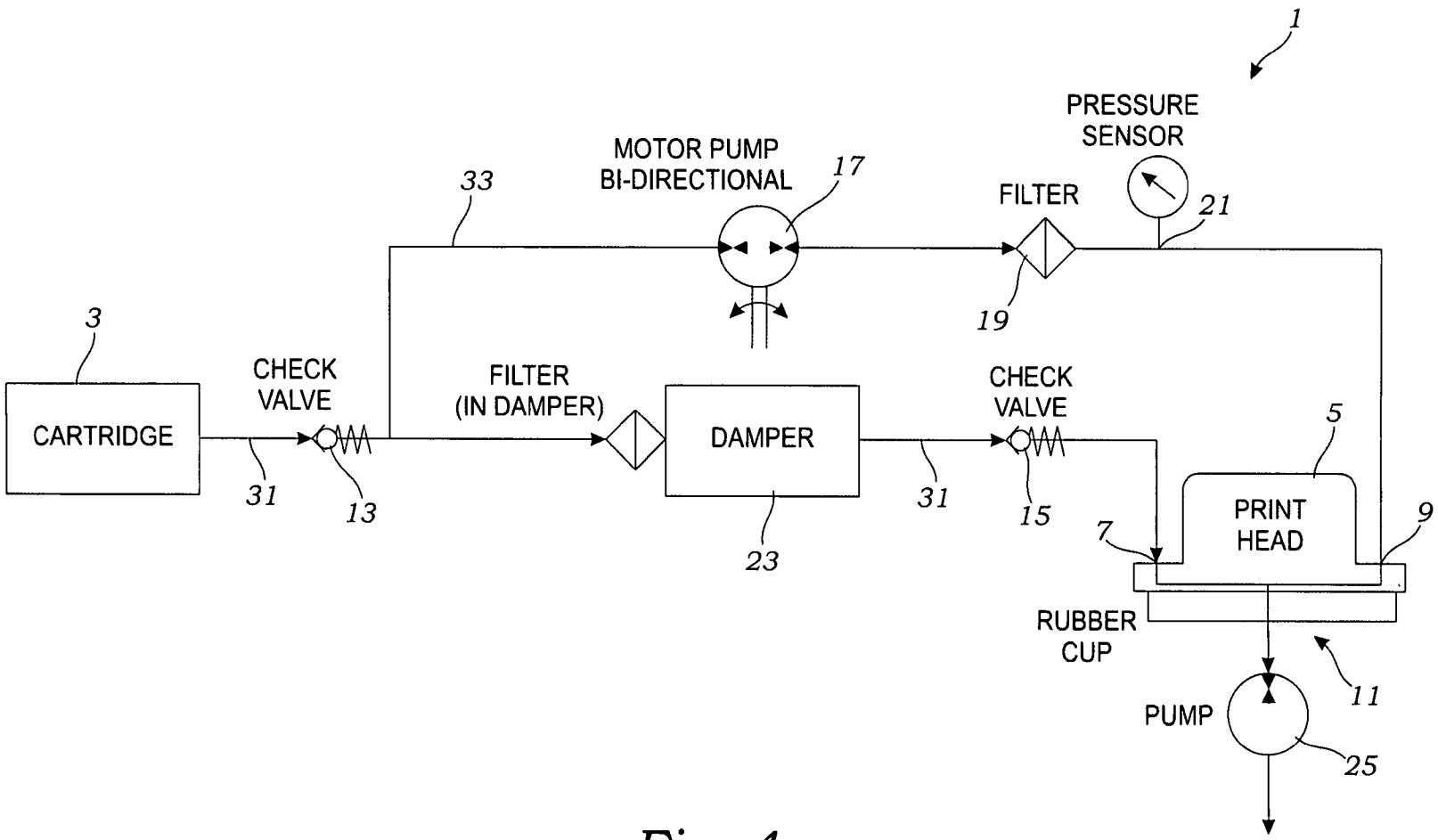
FIG. 4 is a flow chart illustrating the inkjet printer ink delivery system operating in a maintenance "priming" (fill) mode.
Figure 5:
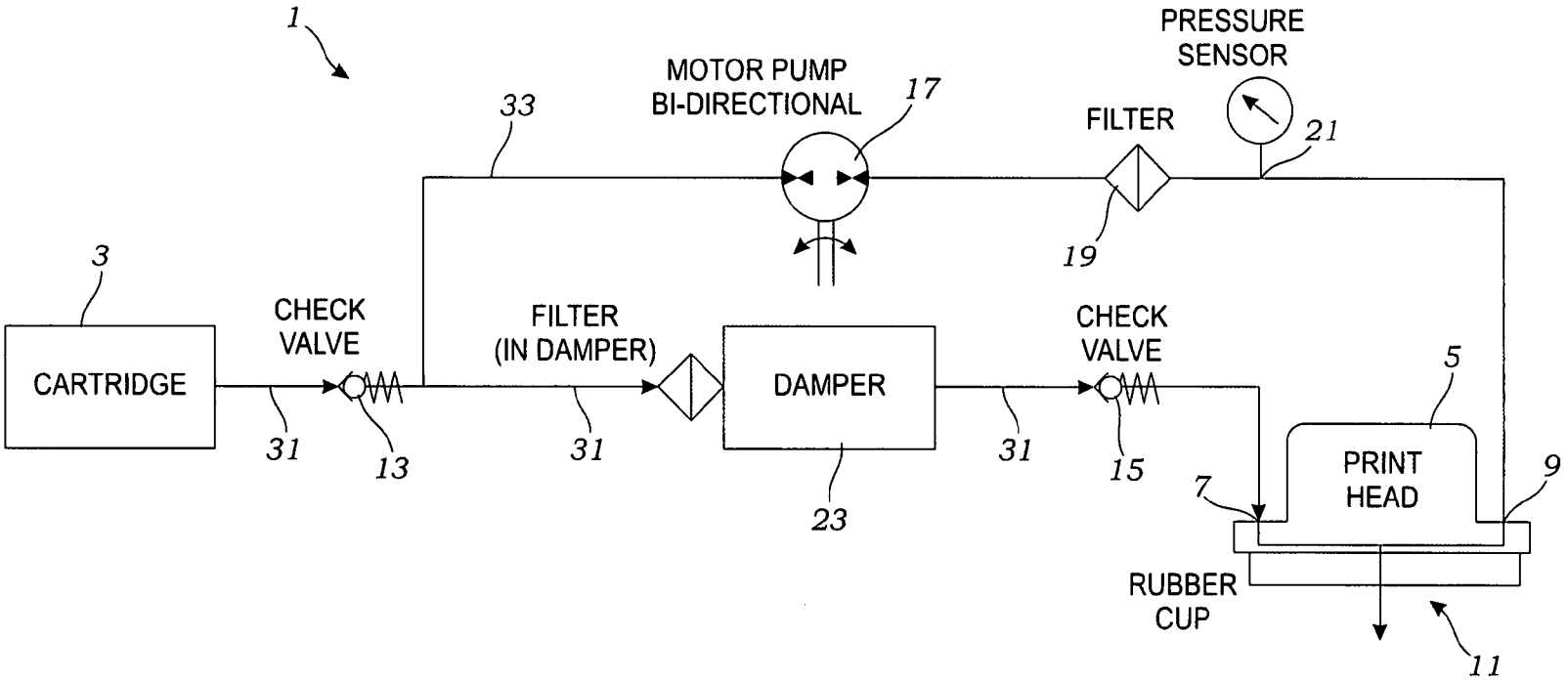
FIG. 5 is a flow chart illustrating the inkjet printer ink delivery system operating in a "print" mode.

In still an additional operational mode illustrated in FIG. 4, during initial setup, when changing ink or when flushing the system with a cleaning solution, a maintenance operation is performed. For this operation, the inkjet printer preferably includes a maintenance station having a rubber cup (not shown) which is pressed against the printhead nozzle 11. The rubber cup is connected to a pump 25 which is activated to provide negative pressure through the first supply path 31 so as to draw ink from the ink supply 3 through the first check valve 13, through the damper 23, check valve 15, through the printhead first port 7, through the printhead 5 so as to be ejected from the printhead nozzle 11.

While several particular forms of the invention have been illustrated in described it would be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently identified the presently preferred embodiments thereof.

I claim:

1. An ink delivery system for use in an inkjet printing apparatus comprising:

a supply tank containing a supply of ink for an inkjet printhead;

an inkjet printhead having a first port, a second port, an ink reservoir and an ink ejection head, with said first port, said second port and said ink ejection head being in fluid communication with one another through said ink reservoir;

a pair of check valves designated as a first check valve and a second check valve, each of said first and second check valves permitting fluid flow in one direction but preventing fluid flow in the opposite direction;

a bidirectional pump having a first pump port and second pump port, said bidirectional pump selectively providing positive pressure to said first pump port while providing negative pressure to said second pump port or alternatively providing negative pressure to said first pump port while providing positive pressure to said second pump port;

a first fluid supply path connecting said supply tank to said inkjet printhead's first port, said first fluid supply path including said first and second check valves with said first and second check valves constructed to permit fluid flow of ink through said first fluid supply path from said supply tank to said inkjet printhead first port but preventing fluid flow in the opposite direction;

a second fluid supply path connecting to said first supply path between said first and second check valves and connecting to said inkjet printhead's second port, said second fluid supply path including said bidirectional pump which directs fluid flow in either direction through said second fluid supply path;

the ink delivery system operable in a print mode to communicate ink from said supply tank through said first supply path to said printhead first port and through said ink reservoir so as to eject ink from said ink ejection head;

the ink delivery system operable in a recirculate mode to recirculate ink through said first supply path and said second supply path and said printhead by operating said bidirectional pump to pump ink through said second supply path from said print head second port to said first supply path which, in turn, causes ink to be communicated through said first supply path to said printhead first port; and the ink delivery system operable in a purge/fill mode to communicate ink from said supply tank to said printhead by operating said bidirectional pump to pump ink through said second supply path from first supply path to said printhead second port so as to eject ink from said ink ejection head.

2. The ink delivery system for use in an inkjet printing apparatus of claim 1 wherein said bidirectional pump obstructs fluid flow through said second supply path when said bidirectional pump is not activated.

3. The ink delivery system for use in an inkjet printing apparatus of claim 1 further comprising damper incorporating a filter, said damper included in said first supply path.

4. The ink delivery system for use in an inkjet printing apparatus of claim 3 wherein said damper is included in said first supply path between said first and second check valves.

5. The ink delivery system for use in an inkjet printing apparatus of claim 1 further comprising a pressure sensor for sensing the pressure in said second supply path.

6. The ink delivery system for use in an inkjet printing apparatus of claim 5 wherein said pressure sensor is included in said second supply path between said bidirectional pump and said printhead second port.

7. A method of ink delivery in an inkjet printing apparatus comprising the steps of:

providing an ink delivery system having a. a supply tank containing a supply of ink for an inkjet printhead;

b. an inkjet printhead having a first port, a second port, an ink reservoir and an ink ejection head, with said first port, said second port and said ink ejection head being in fluid communication with one another through said ink reservoir;

c. a pair of check valves designated as a first check valve and a second check valve, each of said first and second check valves permitting fluid flow in one direction but preventing fluid flow in the opposite direction;

d. a bidirectional pump having a first pump port and second pump port, said bidirectional pump selectively providing positive pressure to said first pump port while providing negative pressure to said second pump port or alternatively providing negative pressure to said first pump port while providing positive pressure to said second pump port;

e. a first fluid supply path connecting said supply tank to said inkjet printhead's first port, said first fluid supply path including said first and second check valves with said first and second check valves constructed to permit fluid flow of ink through said first fluid supply path from said supply tank to said inkjet printhead first port but preventing fluid flow in the opposite direction; and f. a second fluid supply path connecting to said first supply path between said first and second check valves and connecting to said inkjet printhead's second port, said second fluid supply path including said bidirectional pump which directs fluid flow in either direction through said second fluid supply path; and operating the ink delivery system in a recirculate mode to recirculate ink through said first supply path and said second supply path and said printhead by operating said bidirectional pump to pump ink through said second supply path from said print head second port to said first supply path which, in turn, causes ink to be communicated through said first supply path to said printhead first port.

8. The method of ink delivery in an inkjet printing apparatus of claim 7 further comprising the step of:

operating the ink delivery system in a print mode to communicate ink from said supply tank through said first supply path to said printhead first port and through said ink reservoir so as to eject ink from said ink ejection head.

9. The method of ink delivery in an inkjet printing apparatus of claim 8 wherein said bidirectional pump is not activated so as to obstruct fluid flow through said second supply path.

10. The method of ink delivery in an inkjet printing apparatus of claim 7 further comprising the step of:

operating the ink delivery system in a purge/fill mode to communicate ink from said supply tank to said printhead by operating said bidirectional pump to pump ink through said second supply path from first supply path to said printhead second port so as to eject ink from said ink ejection head.

* * * * *